US005620175A

United States Patent [19]

Hesoun

[11] Patent Number: 5,620,175

[45] Date of Patent: Apr. 15, 1997

[54] SHEET FEEDING APPARATUS HAVING A STACK ADVANCING PLATE AND PLATE LOCKING SPRING ELEMENT

[75] Inventor: Peter Hesoun, Linköping, Sweden

[73] Assignee: De La Rue Inter Innovation AB, Sweden

[21] Appl. No.: 602,962

[22] Filed: Feb. 16, 1996

[30] Foreign Application Priority Data

Feb. 17, 1995 [SE] Sweden ..... 9500591

[51] Int. Cl.[6] ..... B65H 3/04; B65H 1/08; B65H 1/26

[52] U.S. Cl. ..... 271/34; 271/126; 271/157; 271/160

[58] Field of Search ..... 271/34, 126, 147, 271/149, 152, 154–157, 160, 213, 214; 221/279, 235

[56] References Cited

U.S. PATENT DOCUMENTS

| | | | |
|---|---|---|---|
| 727,692 | 5/1903 | Rodgers | 271/157 |
| 912,771 | 2/1909 | Angel | 271/157 X |
| 1,538,999 | 5/1925 | Mitchell et al. | 271/214 |
| 1,584,713 | 5/1926 | Barbieri | 271/156 |
| 2,076,186 | 4/1937 | Reynolds et al. | 271/157 X |
| 2,635,876 | 4/1953 | Nichols et al. | 271/156 |
| 2,639,150 | 5/1953 | Aberle | 271/157 X |
| 3,061,304 | 10/1962 | Smit | 271/154 |
| 4,252,251 | 2/1981 | Ek et al. . | |
| 4,978,416 | 12/1990 | Potter et al. | 271/126 X |

FOREIGN PATENT DOCUMENTS

| | | | |
|---|---|---|---|
| 704875 | 12/1979 | U.S.S.R. | 271/147 |

*Primary Examiner*—Boris Milef
*Attorney, Agent, or Firm*—Simmons, Perrine, Albright & Ellwood, P.L.C.

[57] ABSTRACT

An arrangement for feeding sheets from a bundle of sheets includes a wheel, roller or belt which, in operation, is located at one end of the bundle and which functions to feed-out the outermost sheets of the bundle, and a lifting mechanism for lifting the bundle in a direction towards the wheel. The lifting mechanism includes a post and a bundle-carrying plate which is movable up and down the post. The arrangement includes a spring element which functions to lock the plate to the post in a rest state and has a free-end which is fitted to the post and defines, with the longitudinal axis of the post, an angle other than 90° and whose remaining end is attached to the plate and movable perpendicular to the post. The arrangement also includes an actuator which is fitted to the post close to the spring element and which is releasably attached mechanically to a drive mechanism for moving the plate relative to the post. As the actuator is moved along the post, the actuator acts on the spring element so as to release the plate and enable it to move along the post.

11 Claims, 2 Drawing Sheets

SHEET FEEDING APPARATUS HAVING A STACK ADVANCING PLATE AND PLATE LOCKING SPRING ELEMENT

BACKGROUND OF THE INVENTION

1. Field of the Invention

The present invention relates to an arrangement for feeding sheets from a bundle of sheets, and more particularly to an arrangement which includes a wheel, roller or belt which, in operation, is located at one end of the bundle and which functions to feed-out the outermost sheet of said bundle, and lifting means for lifting the bundle in a direction towards the wheel, roller or belt wherein the lifting means includes a post and a bundle-carrying plate which is movable up and down the post.

2. Description of the Related Art

Arrangements for feeding sheets from a bundle of sheets are well known to the art, for instance from U.S. Pat. No. 4,252,251, and have been found to generally function satisfactorily in practice. Unfortunately, the construction of those arrangements generally includes many components where built-in tolerances therebetween must be maintained within narrow limits in order to guarantee effective functioning of the arrangement. As a result, the lifting means of the arrangement is generally expensive to produce.

What is needed is an arrangement for feeding sheets from a bundle of sheets that reduces manufacturing costs, simplifies installation, and has a more robust construction by integrating different components of the arrangement.

SUMMARY OF THE INVENTION

An improved arrangement is provided for feeding sheets from a bundle of sheets. The arrangement includes a spring element which locks a plate to a post in a rest state wherein the free-end of the spring element is fitted to the post and defines an angle other than 90° with the longitudinal axis of the post, and the other end of the spring element is attached to the plate and movable at right angles to the post. An actuator, which is fitted to the post close to the spring element, is releasably fastened mechanically to a drive means for moving the plate relative to the post.

The spring element and the actuator are dimensioned and arranged so that as the actuator is moved in a direction along the post, the actuator will cause the spring element to release its locking action of the plate to the post and therewith enable the plate to be moved along the post.

PRINCIPAL OBJECTS AND ADVANTAGES OF THE INVENTION

The principal objects and advantages of the present invention include providing an arrangement for feeding sheets from a bundle of sheets that reduces manufacturing costs; providing such an arrangement that simplifies installation; and providing such an arrangement that has a more robust construction by integrating different components of the arrangement.

Other principal objects and advantages of this invention will become apparent from the following description taken in conjunction with the accompanying drawings wherein are set forth, by way of illustration and example, certain embodiments of this invention.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
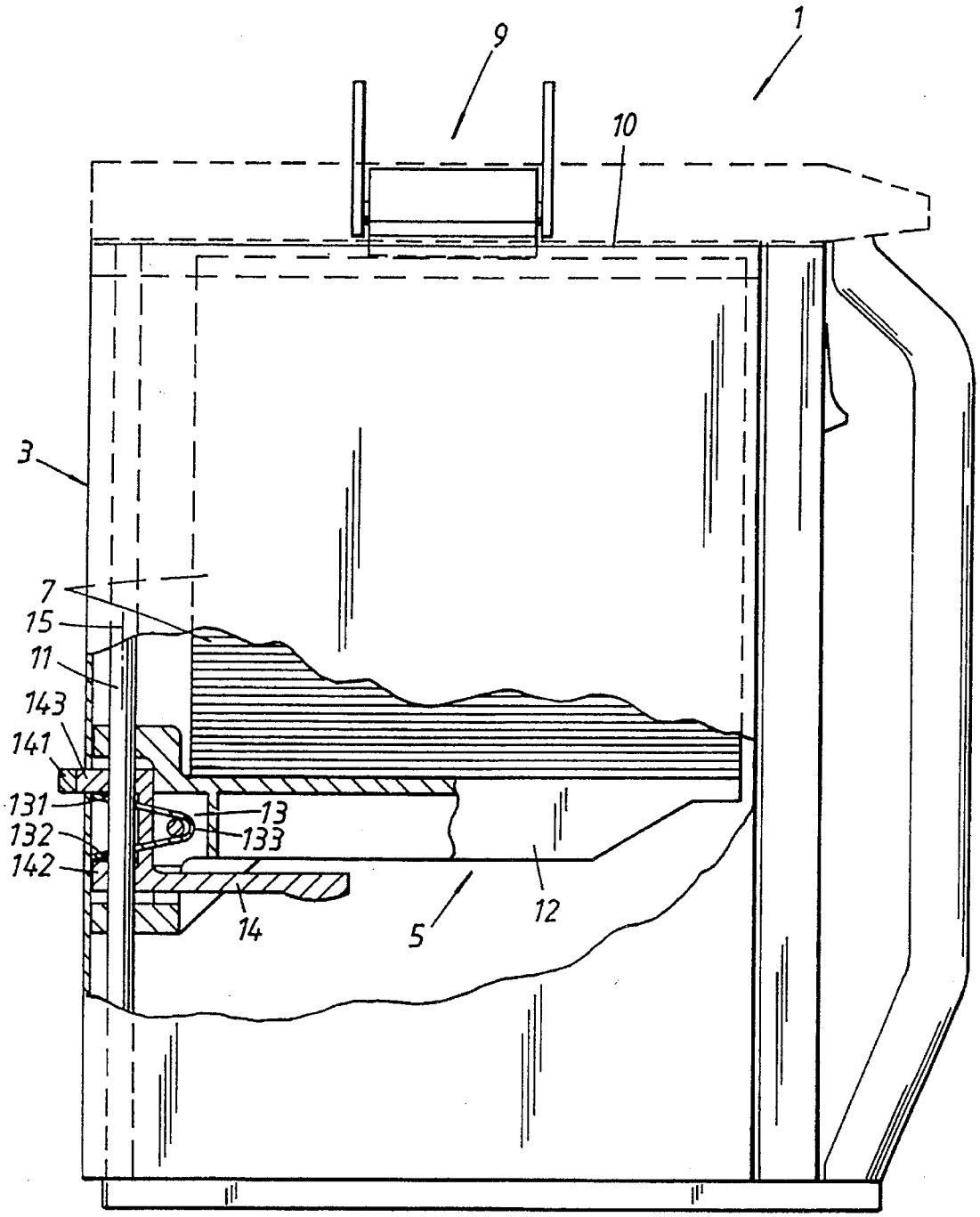
FIG. 1 is a side elevational and schematic, partially cross-sectional view of a cassette utilizing an arrangement for feeding sheets from a bundle of sheets, with portions cut away to reveal details thereof including a post, plate and spring element, according to the present invention.

The reference numeral 1 generally refers to an arrangement for feeding sheets from a bundle of sheets in accordance with the present invention, as shown in FIG. 1.

The arrangement 1 illustrated in FIG. 1 comprises a cassette 3 which includes lifting means 5 which function to lift a bundle of sheets or banknotes 7 in an upwardly direction towards feeding means 9, such as a wheel, roller or belt, for feeding banknotes or sheets singly from the bundle 9 at an upper end 10 of the cassette 3. The lifting means 5 includes a post 11, which extends completely through the cassette 3, and a bundle-carrying plate 12 which can move up and down the post 11.

The arrangement 1 also includes an actuator 14 which is fitted to the post 11 and releasably fastened mechanically to drive means 141 for moving the plate 12 relative to the post 11. The drive means 141 is part of a cassette-embracing casing (not shown) into which the cassette 3 is inserted in conjunction with a banknote dispensing operation. The plate 12 is locked to the post 11 by means of a spring element 13 having two free-ends 131, 132. The free-ends 131, 132 of the spring element 13 are fitted onto the post 11, each defining with a longitudinal axis 15 of the post 11 an angle other than 90° and sloping or facing away from one another, wherein an intermediate part 133, which mutually connects the two free-ends 131 and 132 of the spring element 13, is attached to the plate 12 and is movable perpendicularly to the post 11.

The actuator 14 has two legs 142, 143 and is fitted to the post 11 with the free-ends 131, 132 of the spring element located between the legs 142, 143. The leg 142 is drawn-out (to the right as viewed in FIG. 1) to enable the plate 12 to be maneuvered manually.

The ends 131 and 132 of the spring element 13 must be squeezed together slightly when fitting the spring element 13 to the post 11. When the spring element 13 is fitted in position on the post 11, the spring element 13 locks the plate 12 firmly to the post 11, generally with a bundle of the sheets or banknotes 7 on the plate 12, against upward and downward movement by virtue of the "jamming effect" caused by the ends 131, 132 of the spring element 13 being positioned obliquely to the post 11. In this regard, the ends 131, 132 may be provided with openings or holes that are through-passed by the post 11 and which are dimensioned to allow the post 11 to pass freely therethrough when the ends 131, 132 extend generally perpendicular to the post 11, and to engage the post 11 when the ends 131, 132 are in a sloping position, as shown in the drawings.

The drive means 141 provided in the casing may have, for instance, the form of a screw-threaded spindle, indicated by schematic element designated by the numeral 141, which rotates about its longitudinal axis and engages one end of the leg 143, which in this case may have the form of a nut. When the plate 12 is to be moved along the post 11, for instance downwardly in order to load the cassette 3, the spindle 141 is turned in the actuator leg 143 such as to cause the leg 143 to move the end 131 of the spring element 13 downwards and therewith decrease the obliqueness of its one end with the post axis 15, wherewith the jamming effect is temporarily nullified and the whole the banknote-carrying plate 12 accompanies such downward movement.

It will be noted that as the end 131 of the spring element 13 is caused to move downwards, the intermediate part 133 of the spring element 13 (i.e. the remaining end of the part 131) will be moved generally perpendicularly to the right in relation to the post 11.

When moving the plate 12 in the opposite, upwardly direction, the spindle 141 is turned in the other direction, so that the actuator leg 142 will cause the end 132 of the spring element 13 to move upwards, wherewith the jamming effect is nullified and the whole of the sheet- or banknote-carrying plate 12 will accompany such upward movement.

It is to be understood that the inventive dispensing arrangement 1 can be constructed in many different ways within the scope of the inventive concept expressed herein.

Figure 2:
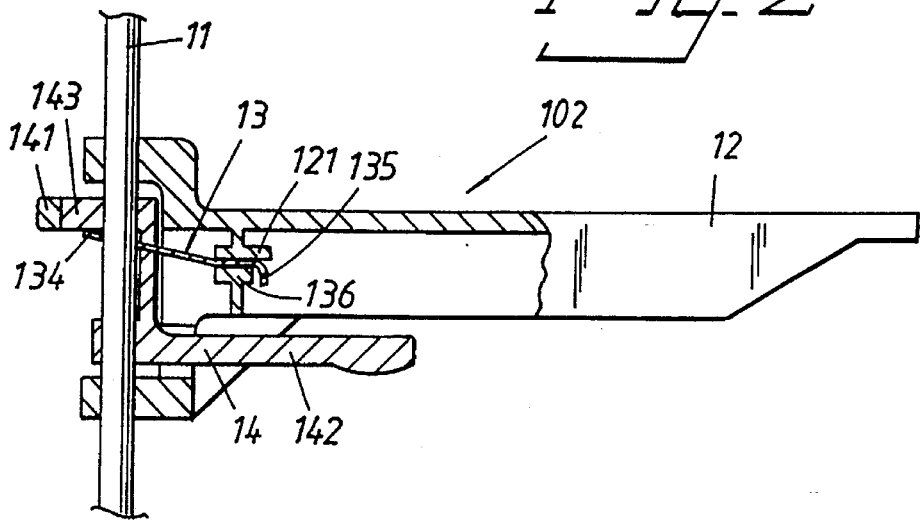
FIGS. 2 through 4 are side elevational and schematic, fragmentary and partially cross-sectional views of modified or alternative embodiments of an arrangement for feeding sheets from a bundle of sheets, with portions cut away to reveal details thereof including a spring element thereof, according to the present invention.

A first modified or alternative embodiment of an arrangement for feeding sheets from a bundle of sheets, generally referenced by the numeral 102 for discussion purposes, is shown in FIG. 2. Many of the characteristics of the first modified or alternative arrangement 102 are substantially similar to those described for the arrangement 1 and are not reiterated in detail here.

As illustrated in FIG. 2, the spring element 13 has only one free-end 134, which is fitted onto the post 11. A remaining end 135 of the spring element 13 is slidably anchored in a groove 136 in an attachment part 121 of the plate 12. This embodiment 102 enables the plate 12 to be moved upwards by gripping the plate 12 and pressing it upwardly. When desiring to move the plate 12 downwardly, it is necessary to cause the actuator 14 to move downwardly, either by engagement of the drive means 141 in the end of the leg 143 outside the cassette 3, or by pulling on the extended end of the leg 142 beneath the plate 12. A possible advantage of the embodiment 102 over the embodiment is that the spring element 13 may be easier to install in the former.

Figure 3:
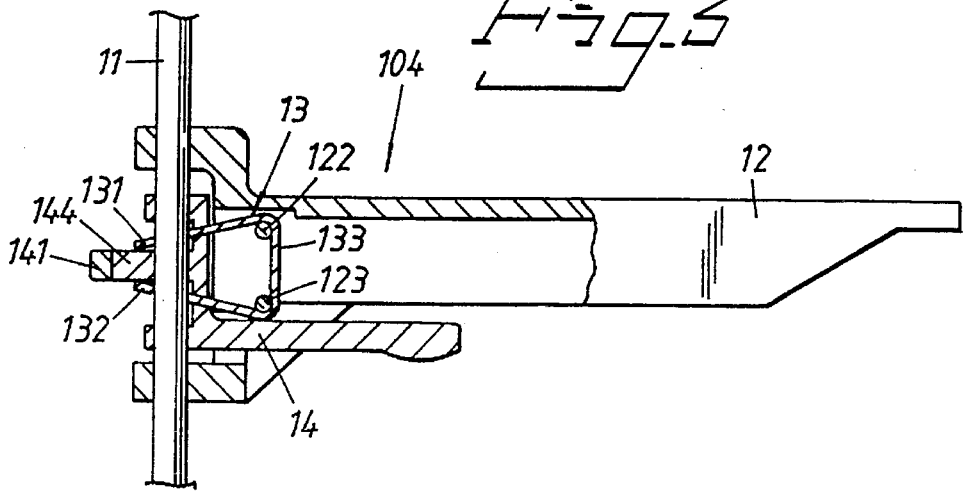

A second modified or alternative embodiment of an arrangement for feeding sheets from a bundle of sheets, generally referenced by the numeral 104 for discussion purposes, is shown in FIG. 3. Many of the characteristics of the second modified or alternative arrangement 104 are substantially similar to other arrangements previously described herein and are not reiterated in detail here.

As illustrated in FIG. 3, the spring element 13 has two free-ends 131, 132, although these ends 131, 132 face towards one another and each lies against a respective side of an actuator leg 144 which is common to both free-ends 131, 132 of the spring element 13. The intermediate part 133 connecting the two ends 131, 132 is anchored around two pins 122, 123 of the plate 12 and can be moved (pivoted) away from the post 11 when the actuator leg 143 acts on the end 131 as the plate 12 is moving upwardly or on the end 132 as the plate 12 is moving downwardly. In other respects, the embodiment 104 functions in substantially the same way as described with reference to the arrangement 1.

Figure 4:
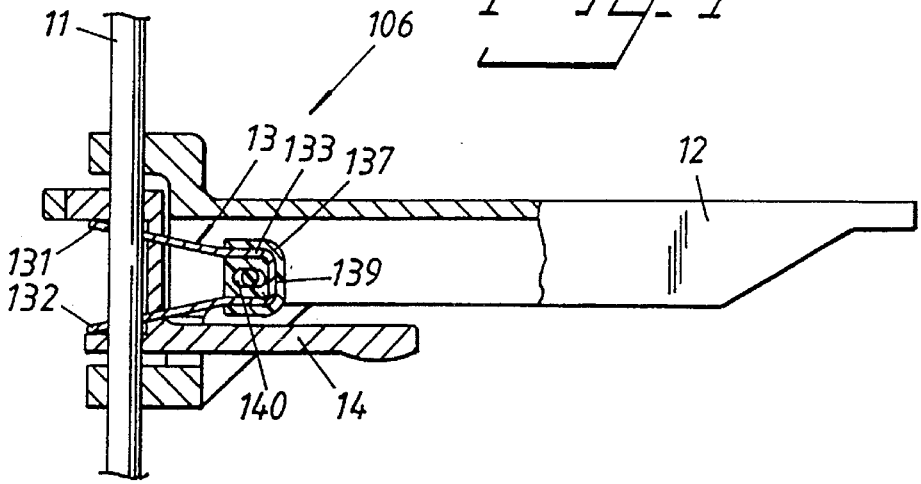

A third modified or alternative embodiment of an arrangement for feeding sheets from a bundle of sheets, generally referenced by the numeral 106 for discussion purposes, is shown in FIG. 4. Many of the characteristics of the third modified or alternative arrangement 106 are substantially similar to other arrangements previously described herein and are not reiterated in detail here.

As illustrated in FIG. 4, the spring element 13 has two free-ends 131, 132 which face away from one another and in which the intermediate part 133 is anchored in a plastic member 137 having a U-shaped groove 139 for receiving the intermediate part 133. Provided centrally in the member 137 is an elongated hole 140 for a screw mounted in the plate 12. This enables the member 137 and, therewith, the spring element 13 to move up and down the post 11 when the spring element 13 is acted upon by the actuator 14.

It is to be understood that while certain forms of the present invention have been illustrated and described herein, it is not to be limited to the specific forms or arrangement of parts described and shown.

What is claimed and desired to be secured by Letters Patent is as follows:

1. An arrangement for feeding sheets from a bundle of sheets, comprising a wheel, roller or belt located, in operation, at one end of the bundle and functioning to feed-out the outermost sheet of the bundle, and lifting means for lifting the bundle in a direction towards said wheel, roller or belt, said lifting means comprising a post and a bundle-carrying plate which can be moved up and down said post, characterized by a spring element having a free-end fitted on said post and defining an angle of other than 90° with the longitudinal axis of said post, and a remaining end attached to said plate for movement perpendicularly to said post, said spring element adapted to cooperatively establish a "jamming effect" with said post to operatively lock said plate to said post in a rest position; drive means for moving said plate relative to said post; and by an actuator which is fitted to said post close to said spring element, which is continuously displaceable along said post, and which is releasably attached mechanically to said drive means for movement of said plate relative to said post, wherein said spring element and said actuator are structured such that said spring element, responsive to displacement of said actuator along said post, releases said "jamming effect" to enable said plate to be displaced along said post.

2. The arrangement according to claim 1, characterized in that said spring element has two free-ends which are fitted to said post and each of which defines with said post an angle other than 90°, wherein said two free-ends face towards one another and an intermediate part connecting said two free-ends together is attached to said plate and movable perpendicularly to said post; and in that said actuator has a part which, when said actuator is fitted to said post, is located between said two free-ends of said spring element.

3. The arrangement according to claim 1, characterized in that said spring element has two free-ends which are fitted onto said post and each of which defines with said post an angle other than 90°, wherein said two free-ends of said spring element face away from each other, and wherein an intermediate part connecting said two free-ends together is attached to said plate and can move perpendicularly to said post; and in that said actuator has two legs which, when said actuator is fitted to said post, are located on respective sides of said two free-ends of said spring element.

4. The arrangement according to claim 3, characterized in that one of said two legs of said actuator is drawn-out to facilitate manual maneuvering of said plate.

5. An arrangement for feeding sheets from a bundle of sheets, comprising:

a) a cassette configured to operatively contain the bundle of sheets;

b) feeding means, spaced at one end of said cassette, for feeding out an outermost sheet of the bundle from said cassette; and c) lifting means for lifting the bundle in a direction towards said feeding means wherein said lifting means comprises a post and a plate that is movable along said post; said lifting means characterized by:

1) a spring element configured to, cooperatively with said post, establish a "jamming effect" to operatively lock said plate to said post as said plate assumes a rest configuration; said spring element having:

A) at least one free-end that is fitted to said post and that is normally non-perpendicular to the longitudinal axis of said post, and B) a remaining end that is connected to said plate and configured to move perpendicularly to said post;

2) drive means for moving said plate relative to said post; and 3) an actuator that is fitted to said post, near said spring element, that is releasably attached mechanically to, and displaceable along said post by, said drive means; and d) wherein said spring element and said actuator are dimensioned and configured, in response to dispacement of said actuator along said post, to operatively release said "jamming effect" and thus enable said plate to move along said post.

6. The arrangement according to claim 5, wherein:

a) said spring element has:

1) two free-ends fitted to said post and facing towards each other, each of said two free-ends being normally non-perpendicular to said longitudinal axis of said post, and 2) an intermediate part attached to said plate, said intermediate part connecting said two free-ends and movable perpendicularly to said post; and b) said actuator has a part located between said two free-ends of said spring element.

7. The arrangement according to claim 5, wherein:

a) said spring element has:

1) two free-ends fitted to said post and facing away from each other, each of said two free-ends being normally non-perpendicular to said longitudinal axis of said post, and 2) an intermediate part attached to said plate, said intermediate part connecting said two free-ends and movable perpendicularly to said post; and b) said actuator has two legs spaced on respective sides of said two free-ends of said spring element.

8. The arrangement according to claim 7, wherein one of said two legs of said actuator is elongated to facilitate manual movement of said plate.

9. The arrangement according to claim 5, wherein said feeding means includes a wheel.

10. The arrangement according to claim 5, wherein said feeding means includes a roller.

11. The arrangement according to claim 6, wherein said feeding means includes a belt.

* * * * *